US007197454B2

(12) United States Patent
Van Der Kerkhof et al.

(10) Patent No.: US 7,197,454 B2
(45) Date of Patent: Mar. 27, 2007

(54) AUDIO CODING

(75) Inventors: Leon Maria Van Der Kerkhof, Eindhoven (NL); Arnoldus Werner Johannes Oomen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 777 days.

(21) Appl. No.: 10/123,791

(22) Filed: Apr. 16, 2002

(65) Prior Publication Data

US 2002/0156619 A1 Oct. 24, 2002

(30) Foreign Application Priority Data

Apr. 18, 2001 (EP) ..... 01201404

(51) Int. Cl.
*G10L 19/00* (2006.01)

(52) U.S. Cl. ..... 704/219; 704/220; 704/500

(58) Field of Classification Search ..... 704/219, 704/220, 500

See application file for complete search history.

(56) References Cited

U.S. PATENT DOCUMENTS 4,348,699 A * 9/1982 Tsuchiya et al. ..... 360/32
4,710,959 A * 12/1987 Feldman et al. ..... 704/207
5,745,650 A * 4/1998 Otsuka et al. ..... 704/260
5,745,651 A * 4/1998 Otsuka et al. ..... 704/268
5,974,380 A * 10/1999 Smyth et al. ..... 704/229
6,021,388 A * 2/2000 Otsuka et al. ..... 704/268
6,108,626 A * 8/2000 Cellario et al. ..... 704/230
6,356,569 B1 * 3/2002 Sonalkar et al. ..... 370/545
6,681,209 B1 * 1/2004 Schmidt et al. ..... 704/500

FOREIGN PATENT DOCUMENTS

WO WO9721310 6/1997

OTHER PUBLICATIONS

"Speech analysis/synthesis based on sinusoidal representation", R. McAulay et al, IEEE Trans. Acoust, Speech, Signal Process, 43:744-754, 1986.

"Technical description of the MPEG-4 audio-coding proposal from the University of Hannover and Deutsche Bundespost Telekom AG(revised", by B. Edler et al, Technical note MPEG95/0414r, Int. Organisation for Standardisation ISO/IEC JTC1/SC29/WG11, 1996.

U.S. Appl. No. 09/804,022, European patent application No. 00200939.7, filed Mar. 15, 2000.

U.S. Appl. No. 09/593,916, PCT patent application No. PCT/EP00/05344, Jun. 14, 2000.

* cited by examiner

*Primary Examiner*—Daniel D. Abebe

(57) ABSTRACT

Coding of an audio signal is provided where the coded bitstream semantics and syntax are not related to a specific sampling frequency. Thus, all bitstream parameters required to regenerate the audio signal, including implicit parameters like frame length, are related to absolute frequencies and absolute timing, and thus not related to sampling frequency.

26 Claims, 2 Drawing Sheets

AUDIO CODING

The present invention relates to coding and decoding audio signals. In particular, the invention relates to low bit-rate audio coding as used in solid-state audio or Internet audio.

Perceptual coders depend on a phenomenon of the human hearing system called masking. Average human ears are sensitive to a wide range of frequencies. However, when a lot of signal energy is present at one frequency, the ear cannot hear lower energy at nearby frequencies, that is, the louder frequency masks the softer frequencies with the louder frequency being called the masker and the softer frequency being called the target. Perceptual coders save signal bandwidth by throwing away information about masked frequencies. The result is not the same as the original signal, but with suitable computation, human ears can't hear the difference. Two specific types of perceptual coders are transform coders and sub-band coders.

In transform coders, in general, an incoming audio signal is encoded into a bitstream comprising one or more frames, each including one or more segments. The encoder divides the signal into blocks of samples (segments) acquired at a given sampling frequency and these are transformed into the frequency domain to identify spectral characteristics of the signal. The resulting coefficients are not transmitted to full accuracy, but instead are quantized so that in return for less accuracy a saving in word length is achieved. A decoder performs an inverse transform to produce a version of the original having a higher, shaped, noise floor. It should be noted that, in general, coefficient frequency values are implicitly determined by the transform length and the sampling frequency or, in other words, the frequency (range) corresponding to a transform coefficient is directly related to the sampling rate.

Sub-band coders (SBC) operate in the same manner as transform coders, but here the transformation into the frequency domain is done by a sub-band filter. The sub-band signals are quantized and coded before transmission. The centre frequency and bandwidth of each sub-band is again implicitly determined by the filter structure and the sampling frequency.

In both the case of transform coders in general and sub-band coders in particular, the resolutions of the applied filters scale directly with the sampling frequency at which the transform or sub-band filter bank operates.

Many signals, however, comprise not only a deterministic component but a non-deterministic or stochastic noise component and Linear Predictive Coding (LPC) is one technique used to represent the spectral shape of this type or component of a signal. In general, an LPC based coder takes blocks of samples from the noisy component or signal and generates filter parameters representing the spectral shape of the block of samples. The decoder can then generate synthetic noise at the same sampling rate and, using the filter parameters calculated from the original signal, generate a signal with an approximation of the spectral shape of the original signal. It can be seen, however, that such coders are designed for one specific sampling frequency at which the decoder has to run using the filter parameters associated with the original sampling frequency. The predictive filter parameters are valid for this sampling frequency only, as a prediction error is to be generated at the specified sampling frequency in order to generate the correct output. (In a few very specific cases, it is possible to run a decoder at another sampling frequency, for example, exactly half the sampling frequency.)

However, the problem with current low bit rate audio coding systems addressed in the present specification including those generally described above and as exemplified in, for example, PCT Application No. WO97/21310 is that a bit stream produced by an encoder relates to a sampling frequency with which the bit stream has been generated by the encoder and at which sampling frequency the decoder has to run to generate the time-domain PCM (Pulse Code Modulation) output signal. Thus, the sampling frequency to be used in the decoder is either incorporated in the bitstream syntax as a parameter for the decoder, or known to the decoder in other ways.

Also, the decoder hardware requires clocking circuitry that can operate at any sampling frequency that may be used by the encoder to generate a coded bitstream. Scalability in terms of computational load for the decoder by means of scaling the output sampling frequency does not exist or is limited to a number of discrete steps.

The present invention provides a method of encoding an audio signal, the method comprising the steps of: sampling the audio signal at a first sampling frequency to generate sampled signal values; analysing the sampled signal values to generate a parametric representation of the audio signal; and generating an encoded audio stream including a parametric representation representative of said audio signal and independent of said first sampling frequency so allowing said audio signal to be synthesized independently of said sampling frequency.

Thus, the coded bitstream semantics and syntax required to regenerate the audio signal, including implicit parameters like frame length, are related to absolute frequencies and absolute timing, and thus not related to sampling frequency.

As such, the output sampling frequency of the decoder does not need to be related to the sampling frequency of the input signal to the encoder and so the encoder and decoder can run at a user selected sampling frequency, independently from each other.

So, the decoder can run at, for example, a single sampling frequency supported by the clocking circuitry of the decoder hardware, or the highest sampling frequency supported by the processing power of the decoder hardware platform.

In a preferred embodiment of the invention, components of the parametric representation include position and shape parameters of transient signal components and tracks representative of linked signal components. In this case, the parameters are encoded as absolute times and frequencies or indicative of absolute times and frequencies independent of the coder sampling frequency. Furthermore, in the embodiment, a component of the parametric representation includes line spectral frequencies representing a noise component of the audio signal independent of the original coder sampling frequency. These line spectral frequencies are represented by absolute frequency values.

An embodiment of the invention will now be described with reference to the accompanying drawings, in which.

Figure 1:
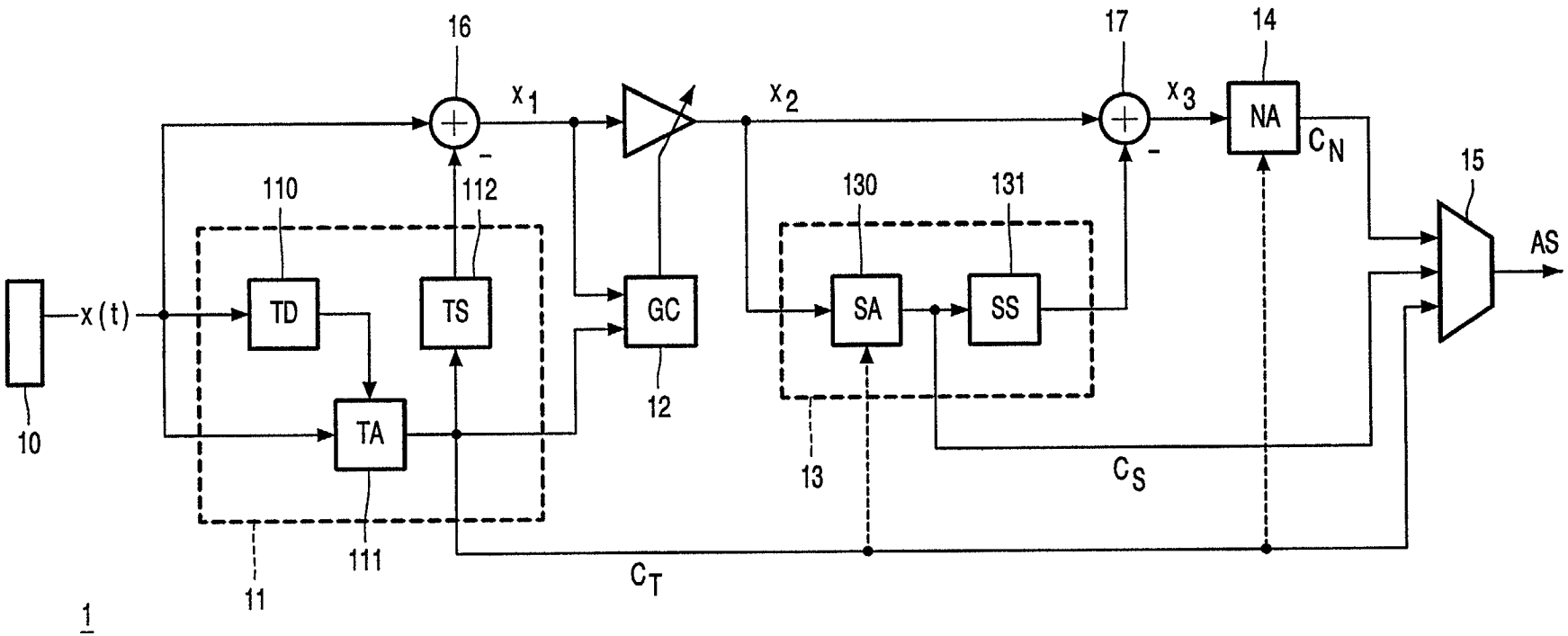
FIG. 1 shows an embodiment of an audio coder according to the invention.

In a preferred embodiment of the present invention, FIG. 1, the encoder is a sinusoidal coder of the type described in European patent application No. 00200939.7, filed 15.03.2000 (Attorney Ref: PH-NL000120). In both the earlier case and the preferred embodiment, the audio coder 1 samples an input audio signal at a certain sampling frequency resulting in a digital representation x(t) of the audio signal. This renders the time-scale t dependent on the sampling rate. The coder 1 then separates the sampled input signal into three components: transient signal components, sustained deterministic components, and sustained stochastic components. The audio coder 1 comprises a transient coder 11, a sinusoidal coder 13 and a noise coder 14. The audio coder optionally comprises a gain compression mechanism (GC) 12.

In this advantageous embodiment of the invention, transient coding is performed before sustained coding. This is advantageous because transient signal components are not efficiently and optimally coded in sustained coders. If sustained coders are used to code transient signal components, a lot of coding effort is necessary; for example, one can imagine that it is difficult to code a transient signal component with only sustained sinusoids. Therefore, the removal of transient signal components from the audio signal to be coded before sustained coding is advantageous. It will also be seen that a transient start position derived in the transient coder may be used in the sustained coders for adaptive segmentation (adaptive framing).

Nonetheless, the invention is not limited to the particular use of transient coding disclosed in the European patent application No. 00200939.7 and this is provided for exemplary purposes only.

The transient coder 11 comprises a transient detector (TD) 110, a transient analyzer (TA) 111 and a transient synthesizer (TS) 112. First, the signal x(t) enters the transient detector 110. This detector 110 estimates if there is a transient signal component and its position. This information is fed to the transient analyzer 111. This information may also be used in the sinusoidal coder 13 and the noise coder 14 to obtain advantageous signal-induced segmentation. If the position of a transient signal component is determined, the transient analyzer 111 tries to extract (the main part of) the transient signal component. It matches a shape function to a signal segment preferably starting at an estimated start position, and determines content underneath the shape function, by employing for example a (small) number of sinusoidal components. This information is contained in the transient code CT and more detailed information on generating the transient code CT is provided in European patent application No. 00200939.7. In any case, it will be seen that where, for example, the transient analyser employs a Meixner like shape function, then the transient code CT will comprise the start position at which the transient begins; a parameter that is substantially indicative of the initial attack rate; and a parameter that is substantially indicative of the decay rate; as well as frequency, amplitude and phase data for the sinusoidal components of the transient. Thus, to implement the present invention, the start position should be transmitted as a time value rather than, for example, a sample number within a frame; and the sinusoid frequencies should be transmitted as absolute values or using identifiers indicative of absolute values rather than values only derivable from or proportional to the transformation sampling frequency. In prior art systems, the latter options are normally chosen as, being discrete values, they are intuitively easier to encode and compress. However, this requires a decoder to be able to regenerate the sampling frequency in order to regenerate the audio signal.

It will also be seen that the shape function may also include a step indication in case the transient signal component is a step-like change in amplitude envelope. In this case, the transient position only affects the segmentation during synthesis for the sinusoidal and noise module. Again, however, the location of the step-like change is encoded as a time value rather than a sample number, which would be related to the sampling frequency.

The transient code CT is furnished to the transient synthesizer 112. The synthesized transient signal component is subtracted from the input signal x(t) in subtractor 16, resulting in a signal x1. In case, the GC 12 is omitted, x1=x2. The signal x2 is furnished to the sinusoidal coder 13 where it is analyzed in a sinusoidal analyzer (SA) 130, which determines the (deterministic) sinusoidal components. The resulting information is contained in the sinusoidal code CS and a more detailed example illustrating the generation of an exemplary sinusoidal code CS is provided in PCT patent application No. PCT/EP00/05344 (Attorney Ref: N 017502). Alternatively, a basic implementation is disclosed in "Speech analysis/synthesis based on sinusoidal representation", R. McAulay and T. Quartieri, IEEE Trans. Acoust., Speech, Signal Process., 43:744–754, 1986 or "Technical description of the MPEG-4 audio-coding proposal from the University of Hannover and Deutsche Bundespost Telekom AG (revised)", B. Edler, H. Purnhagen and C. Ferekidis, Technical note MPEG95/0414r, Int. Organisation for Standardisation ISO/IEC JTC1/SC29/WG11, 1996.

In brief, however, the sinusoidal coder of the preferred embodiment encodes the input signal x2 as tracks of sinusoidal components linked from one frame segment to the next. The tracks are initially represented by a start frequency, a start amplitude and a start phase for a sinusoid beginning in a given segment—a birth. Thereafter, the track is represented in subsequent segments by frequency differences, amplitude differences and, possibly, phase differences (continuations) until the segment in which the track ends (death). In practice, it may be determined that there is little gain in coding phase differences. Thus, phase information need not be encoded for continuations at all and phase information may be regenerated using continuous phase reconstruction. Again, to implement the present invention, the start frequencies are encoded within the sinusoidal code CS as absolute values or identifiers indicative of absolute frequencies to ensure the encoded signal is independent of the sampling frequency.

From the sinusoidal code CS, the sinusoidal signal component is reconstructed by a sinusoidal synthesizer (SS) 131. This signal is subtracted in subtractor 17 from the input x2 to the sinusoidal coder 13, resulting in a remaining signal x3 devoid of (large) transient signal components and (main) deterministic sinusoidal components.

The remaining signal x3 is assumed to mainly comprise noise and the noise analyzer 14 of the preferred embodiment produces a noise code CN representative of this noise. Conventionally, as in, for example, PCT patent application No. PCT/EP00/04599, filed 17.05.2000 (Attorney Ref: PH NL000287) a spectrum of the noise is modelled by the noise coder with combined AR (auto-regressive) MA (moving average) filter parameters (pi,qi) according to an Equivalent Rectangular Bandwidth (ERB) scale. Within the decoder, FIG. 2, the filter parameters are fed to a noise synthesizer NS 33, which is mainly a filter, having a frequency response approximating the spectrum of the noise. The NS 33 generates reconstructed noise yN by filtering a white noise signal with the ARMA filtering parameters (pi,qi) and subsequently adds this to the synthesized transient yT and sinusoid yS signals.

However, the ARMA filtering parameters (pi,qi) are again dependent on the sampling frequency of the noise analyser and so, to implement the present invention, these parameters are transformed into line spectral frequencies (LSF) also known as Line Spectral Pairs (LSP) before being encoded. These LSF parameters can be represented on an absolute frequency grid or a grid related to the ERB scale or Bark scale. More information on LSP can be found at "Line Spectrum Pair (LSP) and speech data compression", F. K. Soong and B. H. Juang, ICASSP, pp. 1.10.1, 1984. In any case, such transformation from one type of linear predictive filter type coefficients in this case (pi,qi) dependent on the encoder sampling frequency into LSFs which are sampling frequency independent and vice versa as is required in the decoder is well known and is not discussed further here. However, it will be seen that converting LSFs into filter coefficients (p'i,q'i) within the decoder can be done with reference to the frequency with which the noise synthesizer 33 generates white noise samples, so enabling the decoder to generate the noise signal yN independently of the manner in which it was originally sampled.

It will be seen that, similar to the situation in the sinusoidal coder 13, the noise analyzer 14 may also use the start position of the transient signal component as a position for starting a new analysis block. Thus, the segment sizes of the sinusoidal analyzer 130 and the noise analyzer 14 are not necessarily equal.

Finally, in a multiplexer 15, an audio stream AS is constituted which includes the codes CT, CS and CN. The audio stream AS is furnished to e.g. a data bus, an antenna system, a storage medium etc.

Figure 2:
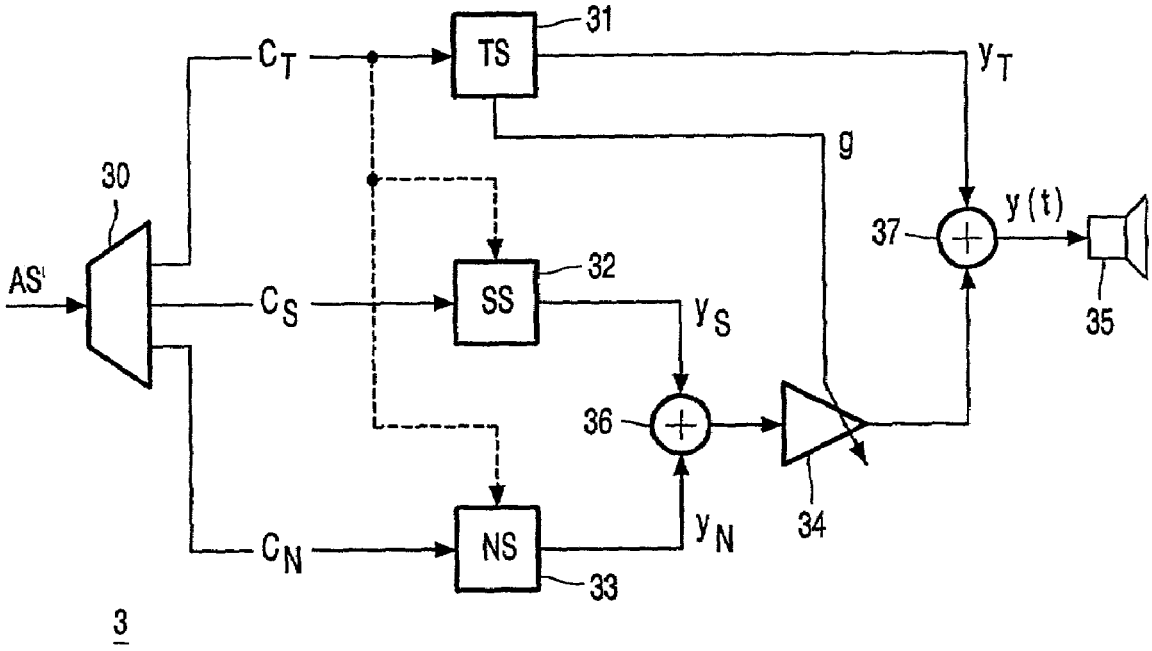
FIG. 2 shows an embodiment of an audio player according to the invention.

FIG. 2 shows an audio player 3 according to the invention. An audio stream AS', e.g. generated by an encoder according to FIG. 1, is obtained from the data bus, antenna system, storage medium etc. The audio stream AS is de-multiplexed in a de-multiplexer 30 to obtain the codes CT, CS and CN. These codes are furnished to a transient synthesizer 31, a sinusoidal synthesizer 32 and a noise synthesizer 33 respectively. From the transient code CT, the transient signal components are calculated in the transient synthesizer 31. In case the transient code indicates a shape function, the shape is calculated based on the received parameters. Further, the shape content is calculated based on the frequencies and amplitudes of the sinusoidal components. If the transient code CT indicates a step, then no transient is calculated. The total transient signal yT is a sum of all transients.

If adaptive framing is used, then from the transient positions, a segmentation for the sinusoidal synthesis SS 32 and the noise synthesis NS 33 is calculated. The sinusoidal code CS is used to generate signal yS, described as a sum of sinusoids on a given segment. The noise code CN is used to generate a noise signal yN. To do this, the line spectral frequencies for the frame segment are first transformed into ARMA filtering parameters (p'i,q'i) dedicated for the frequency at which the white noise is generated by the noise synthesizer and these are combined with the white noise values to generate the noise component of the audio signal. In any case, subsequent frame segments are added by, e.g. an overlap-add method.

The total signal y(t) comprises the sum of the transient signal yT and the product of any amplitude decompression (g) and the sum of the sinusoidal signal yS and the noise signal yN. The audio player comprises two adders 36 and 37 to sum respective signals. The total signal is furnished to an output unit 35, which is e.g. a speaker.

Figure 3:
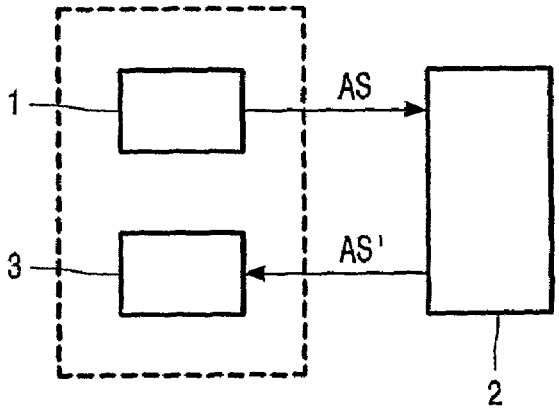
FIG. 3 is shows a system comprising an audio coder and an audio player.

FIG. 3 shows an audio system according to the invention comprising an audio coder 1 as shown in FIG. 1 and an audio player 3 as shown in FIG. 2. Such a system offers playing and recording features. The audio stream AS is furnished from the audio coder to the audio player over a communication channel 2, which may be a wireless connection, a data bus or a storage medium. In case the communication channel 2 is a storage medium, the storage medium may be fixed in the system or may also be a removable disc, memory stick etc. The communication channel 2 may be part of the audio system, but will however often be outside the audio system.

In summary, it will be seen that the coder of the preferred embodiment is based on the decomposition of a wideband audio signal into three types of components:

Sinusoidal components, of which absolute frequencies are transmitted in the bitstream, Transient components, of which an absolute position transient position within a frame segment is transmitted, the transient envelope is specified on an absolute time scale, and sinusoidal components of which absolute frequencies are transmitted in the bitstream, Noise components, of which Line Spectral Frequencies are transmitted in the bit stream.

Furthermore, frame length should be specified in absolute time, instead of in the number of samples as in state-of-the-art coders.

With such a coder, the decoder can run on any sampling frequency. However, the full bandwidth can of course only be obtained if the sampling frequency is at least twice the highest frequency of any component contained in the bitstream. For a certain application, it is possible to pre-define the minimum bandwidth (or sampling frequency) to be used in the decoder in order to obtain the full bandwidth available in the bit-stream. In a more advantageous embodiment, a recommended minimum bandwidth (or sampling frequency) is included in the bitstream, e.g. in the form of an indicator of one or more bits. This recommended minimum bandwidth can be used in a suitable decoder to determine the minimum bandwidth/sampling frequency to be used in order to obtain the full bandwith available in the bitstream.

It should also be seen that time scaling and pitch shift are inherently supported by such a system. Time scaling simply comprises using a different absolute frame length than the one selected by the encoder. Pitch shift can be obtained simply by multiplying all absolute frequencies by a certain factor.

It is observed that the present invention can be implemented in dedicated hardware, in software running on a DSP (Digital Signal Processor) or on a general purpose computer. The present invention can be embodied in a tangible medium such as a CD-ROM or a DVD-ROM carrying a computer program for executing an encoding method according to the invention. The invention can also be embodied as a signal transmitted over a data network such as the Internet, or a signal transmitted by a broadcast service.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

In summary, coding of an audio signal is provided where the coded bitstream semantics and syntax are not related to a specific sampling frequency. Thus, all bitstream parameters required to regenerate the audio signal, including implicit parameters like frame length, are related to absolute frequencies and absolute timing, and thus not related to sampling frequency.

The invention claimed is:

1. A method of encoding an audio signal, the method comprising the acts of:

sampling the audio signal at a sampling frequency to generate sampled signal values;

analyzing the sampled signal values to generate a parametric representation of the audio signal; and generating an encoded audio stream including said parametric representation representative of said audio signal and independent of said sampling frequency so allowing said audio signal to be synthesized independently of said sampling frequency.

2. A method as claimed in claim 1, the method further comprising the acts of:

modeling a noise component of the audio signal by determining filter parameters of a filter which has a frequency response approximating a target spectrum of the noise component, and converting the filter parameters to parameters independent of the sampling frequency.

3. A method as claimed in claim 2 wherein said filter parameters are auto-regressive and moving average parameters and said independent parameters are indicative of Line Spectral Frequencies.

4. A method as claimed in claim 3 wherein said independent parameters are represented in one of absolute frequencies or a Bark scale or an ERB scale.

5. A method as claimed in claim 1 wherein said method further comprises the acts of:

estimating a position of a transient signal component in the audio signal;

matching a shape function having shape parameters and a position parameter to said transient signal, wherein said position parameter is representative of an absolute time location of said transient signal component in said audio signal; and including the position and shape parameters describing the shape function in said audio stream.

6. A method as claimed in claim 5 wherein said matching act is responsive to said transient signal component declining after an initial increase to provide a shape function having a substantially exponential initial behavior and a substantially logarithmic declining behavior.

7. A method as claimed in claim 6, the method further comprising the act of:

flattening a part of the audio signal that is furnished to at least one sustained coding stage by using the shape function in a gain control mechanism.

8. A method as claimed in claim 5, wherein an initial behavior of the shape function is substantially according to $t_n$ and a declining behavior of the shape function is substantially according to $e_{-\alpha t}$, where t is time and n and $\alpha$ are parameters.

9. A method as claimed in claim 5, wherein said matching act is responsive to said transient signal component being a step-like change in amplitude to provide a shape function indicating a step transient.

10. A method as claimed in claim 1, the method further comprising the acts of:

modeling a sustained signal component of the audio signal by determining tracks representative of linked signal components present in subsequent signal segments; and extending said tracks on the basis of parameters of linked signal components already determined, wherein the parameters for a first signal component in a track include a parameter representative of an absolute frequency of said signal component.

11. A method as claimed in claim 1, wherein the act of generating an encoded audio stream comprises including a recommended minimum bandwidth to be used by a decoder or an indicator of the sampling frequency in the audio stream.

12. Method of decoding an audio stream, the method comprising, the acts of:

reading an encoded audio stream representative of an audio signal including a parametric representation independent of a coder sampling frequency; and employing said parametric representation to synthesize said audio signal independently of said coder sampling frequency.

13. Audio coder, comprising:

a sampler for sampling an audio signal at a sampling frequency to generate sampled signal values;

an analyzer for analyzing the sampled signal values to generate a parametric representation of the audio signal; and a bit stream generator for generating an encoded audio stream including said parametric representation representative of said audio signal and independent of said sampling frequency so allowing said audio signal to be synthesized independently of said sampling frequency.

14. Audio system comprising an audio coder as claimed in claim 13.

15. The audio coder of claim 13, wherein said analyzer is configured to:

model a noise component of the audio signal by determining filter parameters of a filter which has a frequency response approximating a target spectrum of the noise component, and convert the filter parameters to independent parameters that are independent of the first sampling frequency.

16. The audio coder of claim 15, wherein said filter parameters are auto-regressive and moving average parameters and said independent parameters are indicative of Line Spectral Frequencies.

17. The audio coder of claim 15, wherein said independent parameters are represented in one of absolute frequencies or a Bark scale or an ERB scale.

18. The audio coder of claim 13, wherein said analyzer is configured to:

estimate a position of a transient signal component in the audio signal;

match a shape function having shape parameters and a position parameter to said transient signal, wherein said position parameter is representative of an absolute time location of said transient signal component in said audio signal; and include the position and shape parameters describing the shape function in said audio stream.

19. The audio coder of claim 18, wherein said analyzer matches said shape function in response to said transient signal component declining after an initial increase to provide a shape function having a substantially exponential initial behavior and a substantially logarithmic declining behavior.

20. The audio coder of claim 18, wherein an initial behavior of the shape function is substantially according to $t^n$, and a declining behavior of the shape function is substantially according to $e^{-\alpha t}$, where t is time and n and $\alpha$ are parameters.

21. The audio coder of claim 18, wherein said analyzer matches said shape function in response to said transient signal component being a step-like change in amplitude to provide a shape function indicating a step transient.

22. The audio coder of claim 13, wherein said analyzer is configured to flatten a part of the audio signal that is furnished to at least one sustained coding stage by using a shape function in a gain control mechanism.

23. The audio coder of claim 13, wherein said analyzer is configured to:

model a sustained signal component of the audio signal by determining tracks representative of linked signal components present in subsequent signal segments; and extend said tracks on the basis of parameters of linked signal components already determined, wherein the parameters for a first signal component in a track include a parameter representative of an absolute frequency of said signal component.

24. The audio coder of claim 13, wherein said bit stream generator is configured to include a recommended minimum bandwidth to be used by a decoder or an indicator of the sampling frequency in the encoded audio stream.

25. Audio player, comprising:

means for reading an encoded audio stream representative of an audio signal including a parametric representation independent of a coder sampling frequency; and a synthesizer arranged to employ said parametric representation to synthesize said audio signal independently of said coder sampling frequency.

26. Audio stream stored on a storage medium comprising parameters representative of an audio signal and independent of a coder sampling frequency allowing said audio signal to be synthesized independently of said coder sampling frequency.

* * * * *